United States Patent [19]

Thaxton, Jr.

[11] Patent Number: 4,937,905

[45] Date of Patent: Jul. 3, 1990

[54] BED EXTENDER

[76] Inventor: John W. Thaxton, Jr., 1326 Terry Ave., South Boston, Va. 24592

[21] Appl. No.: 448,230

[22] Filed: Dec. 11, 1989

[51] Int. Cl.[5] ..... A47C 19/04

[52] U.S. Cl. ..... 5/508; 5/181; 5/285

[58] Field of Search ..... 5/181, 184, 185, 240, 5/285, 202, 503, 508

[56] References Cited

U.S. PATENT DOCUMENTS 3,064,278 11/1962 Broyles ..... 5/184

3,327,328 6/1967 Slivoski ..... 5/181

3,688,321 9/1972 Moss et al. ..... 5/184

*Primary Examiner*—Alexander Grosz

*Attorney, Agent, or Firm*—Olive & Olive

[57] ABSTRACT

A bed extender device having a pair of opposed vertical leg members and a horizontal extender board affixed to the leg members and maintaining them in an opposed fixed relationship is positioned between and supported on conventional bed rails to provide added length to the conventional bed. The leg members are formed in a manner such that the extender board can be adjusted vertically on the rails.

5 Claims, 2 Drawing Sheets

BED EXTENDER

BACKGROUND OF INVENTION

1. Technical Field

The present invention relates to beds and more specifically to a simple, inexpensive means for extending the length of a bed for convenience and comfort of a tall person.

2. Background Art

Various makeshift arrangements have been employed for extending the length of a conventional bed of the type on which the mattress and box springs rest on a pair of right angle shaped bed rails for use by a relatively tall individual. However, applicant is unaware of any such device being available in the bed industry and particularly such a device which is simple, inexpensive and of a form such that the device can be incorporated into the described type of conventional bed without physical modification of the bed structure enabling the bed to be easily returned to its original form.

SUMMARY OF THE INVENTION

In accordance with the present invention, applicant provides a bed extender device comprising a pair of vertical legs and a flat horizontal extender board the bottom end surfaces of which are removably secured to the legs. The bed extender legs are designed to fit onto the standard right angle bed rails without necessitating the use of any tools and are vertically adjustable on the rail. Thus, an extension to any length bed of this type is achievable without requiring the purchase of new and longer and generally expensive mattress and box springs. The invention apparatus is disclosed as being adaptable to a bed having a footboard as well as to a bed not having a footboard.

BEST MODE FOR CARRYING OUT THE INVENTION

Figure 3:
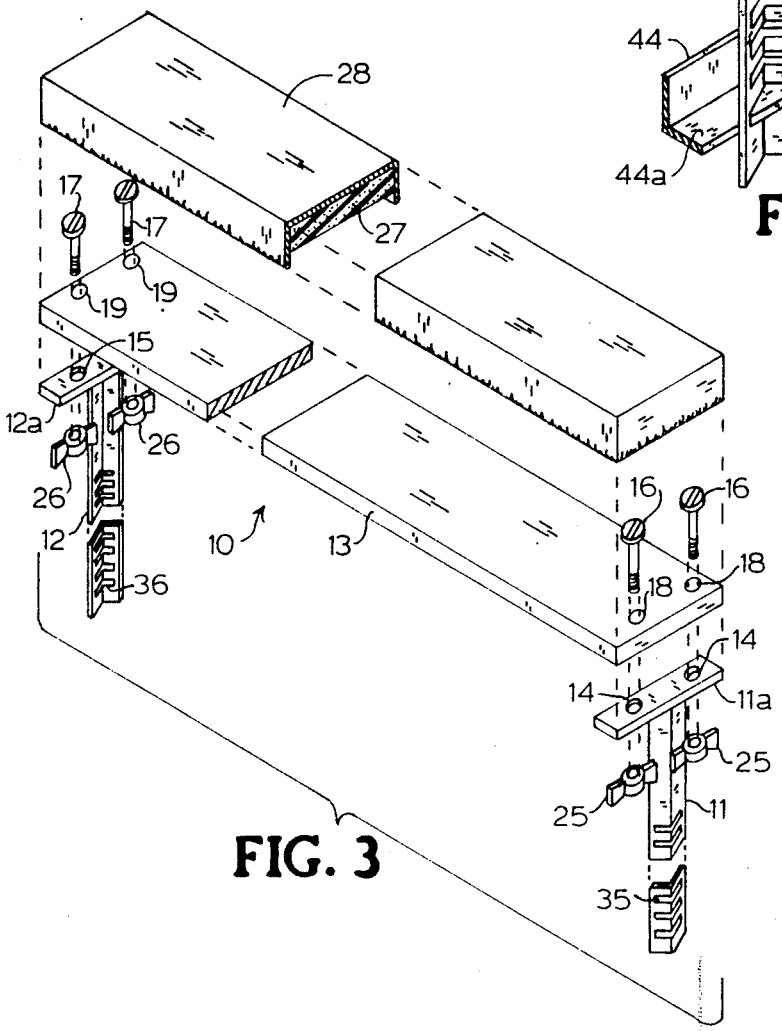
FIG. 3 is an exploded, perspective view of the bed extender device of the present invention.

Referring to the drawings, a bed extender device 10 constructed in accordance with the present invention is best seen in FIG. 3. Bed extender 10 is made up of a pair of vertical angle iron leg members 11, 12 and a horizontal flat extender board 13. Leg member 11 has a horizontal flat metal plate **11*a* welded to its uppermost end. Likewise, leg member 12 has a horizontal flat metal plate 12*a* welded to its uppermost end. Plates 11*a*, 12*a* have holes 14, 15 respectively therein of a diameter suitable to accept threaded bolts 16, 17** respectively.

Extender board 13 has holes 18, 19 which align and mate respectively with holes 14, 15. Extender board 13 rests on metal plates **11*a*, 12*a* so that holes 14, 18 and holes 15, 19 align. Bolts 16, 17 pass through holes 14, 18 and 15, 19 respectively and receive wing nuts 25, 26 respectively. Once wing nuts 25, 26 are tightened, extender 10 assumes the form of being an integral unit. In order to achieve both asthetics and comfort, extender board 13 is provided with a cushion pad 27 which in turn receives a removable cloth covering 28 which covers cushion 27, board 13 and plates 11*a*, 12*a*. Thus, a pillow rest surface is provided for the sleeper's comfort. Covering 28 is preferably formed of a washable fabric and may be form fitted in the manner of a form fitted sheet or held with tie strings, elastic, or the like. The length of extender board 13 is determined by the width of the bed being used, e.g. single beds are 39"W×74"L; ¾ beds are 45"W×74"L; full-size beds are 54"W×74"L; queen-size beds are 60"W ×80"L; and king-size beds are 80"W×80"L. While the width of board 13** may vary, a 6" width is normally found sufficient for the average tall person.

Figure 4:
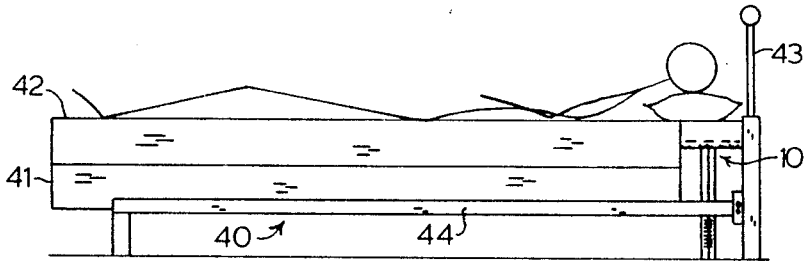
FIG. 4 is a side elevation view of the FIG. 1 extender arrangement.
Figure 5:
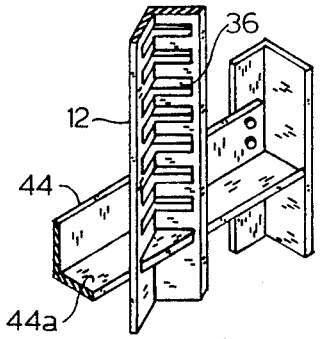
FIG. 5 is a fragmentary perspective view of one of the angle iron leg members illustrating how it is mounted on a conventional bed frame right angle bed rail.

Angle iron legs members 11, 12 have horizontally disposed slots 35, 36 respectively formed therein along a predetermined length thereof. Slots 35, 36 engage the horizontal frame portion **44*a* of the right angle bed rail (FIG. 5) and this allows for vertical or height adjustment of bed extender 10, as best seen in FIG. 5. The top of bed extender 10 once installed, forms a continuation of the bed mattress as seen, for example, in FIG. 4**.

Figure 1:
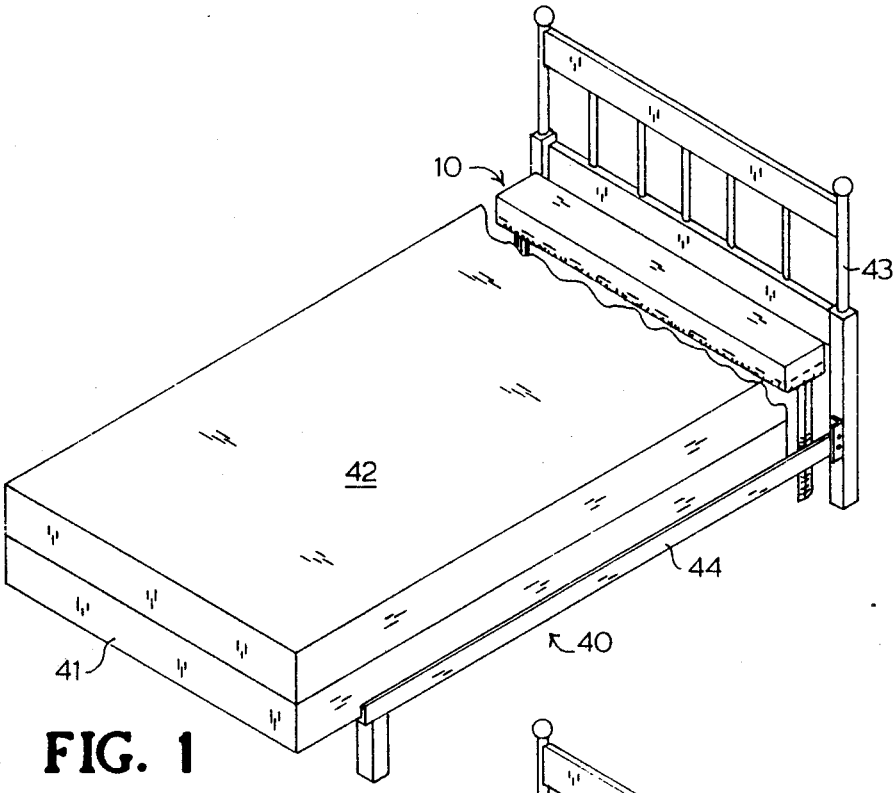
FIG. 1 is a perspective view of the bed extender device of the present invention with the extender device employed on the right angle shaped bed rails a conventional full-sized bed without a footboard and with only one of the bed rails being shown.

Having described how bed extender 10 is fabricated, the description will now focus on several modes of application. FIG. 1 illustrates bed extender 10 employed with a full-size bed, e.g. 54"W×74"L which allows the user, i.e. a tall person, to increase the length of his or her bed without having to resort to purchase of a queen or king-size bed or be forced to accommodate to the sometimes undesirable added width of the larger bed in a small size bedroom. In the FIG. 1 arrangement, the conventional full-size bed frame 40, without a footboard, is employed. Box springs 41 and mattress 42 are slid away from the headboard 43 a distance sufficient to allow the individual to place bed extender 10 between the right angle bed bed rails 44 so that the desired height slots 35, 36 may be selected and which will be determined by the height of the mattress top. Bed extender 10 is first placed between the right angle bed rails 44 at an angle and then straightened and moved into a position adjacent headboard 43 in which board 13 is generally parallel to the headboard. Once in place, box springs 41 and mattress 42 are slid toward the headboard until they butt against bed extender board 13 and its pad 27 and covering 28. Extender board 13 as mentioned above, is typically six inches in width though it may vary. This additional six inches effectively makes the full-size bed now 80" in length. Mattress 42 and box springs 41 in the example of FIG. 1, extend beyond the end of bed frame 40 approximately 6" and which has been found satisfactory in use.

While referred to as a "board", it is to be recognized that board 13 may be formed of wood, plastic or any suitable material. Legs 11 and 12 may also be made of any suitable material and the entire device may be molded as an integral molded device.

Figure 2:
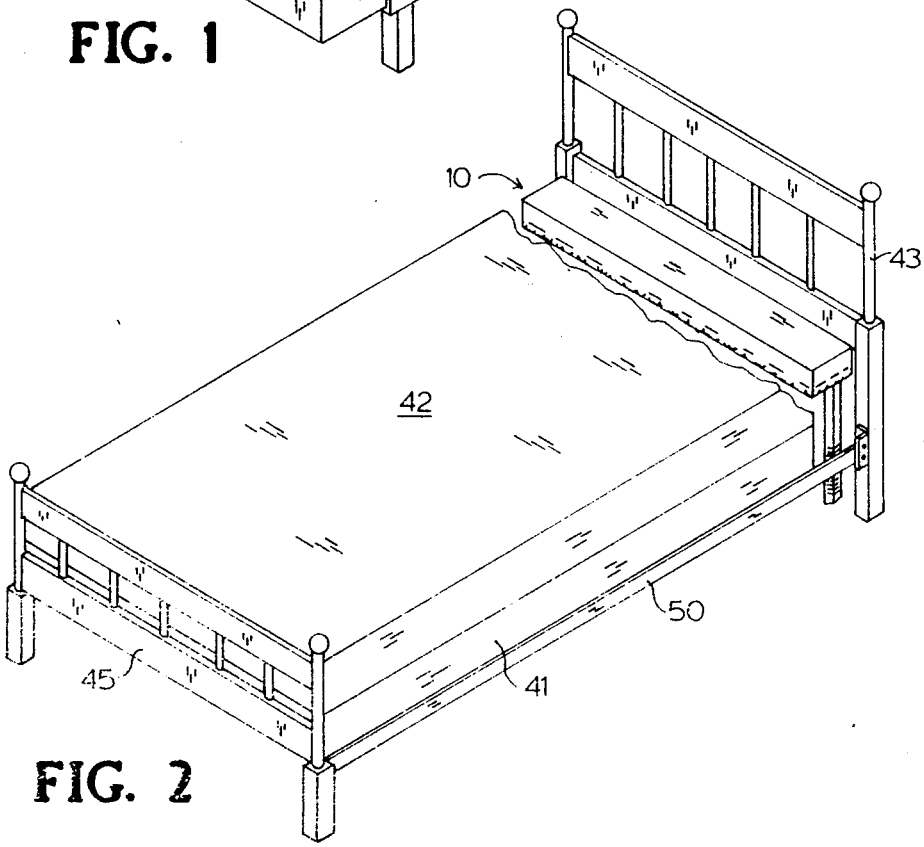
FIG. 2 is a perspective view of the invention device employed in a conversion of a conventional full-sized bed of the type described into a longer or extended resting surface such as a so-called queen-size length.

FIG. 2 illustrates a conventional full-size bed with right angle bed rails and having a footboard 45. In this application, the conventional full-size box springs 41 and mattress 42 and right angle bed rails are removed from the bed and a pair of queen-size right angle bed rails 50 are substituted. Extender 10 is then moved into position as in the FIG. 1 arrangement. Once extender 10 is in place adjacent headboard 43 and properly height positioned, mattress 42 and box springs 41 are repositioned. The individual now has a full-size bed which has been effectively extended to 80" in length but which still uses the full-size mattress and box springs. In an alternative arrangement, bed extender 10 is positioned adjacent the footboard 45 with the mattress 42 and box springs 41 adjacent the headboard 43. This arrangement allows the extender 10 to be covered by the bed linens and the users head to rest on the mattress 42 rather than on the cushion pad 27 as in FIG. 4.

While not illustrated, bed extender 10 when board 13 is 6" in width may also be utilized to extend queen and king-size bed lengths from the normal 80" in length to 86" in length. Many tall persons find even an 80" length bed inadequate but mattresses and box springs do not come in larger sizes. The present invention would allow these individuals to acquire additional length to their beds. In the case of the king-size bed of the type in which central rails are employed to support a pair of box springs and on which rests a single king-size mattress, the invention extender may be made up as a pair of extenders fitted to the central rails and outer rails rather than only to the outer rails.

While preferred embodiments of the invention have been shown and described, it will be apparent that other variations, modifications and embodiments of the invention are possible and accordingly all such variations, modifications and embodiments are to be regarded as being within the spirit and scope of the invention.

I claim:

1. A bed extender device for providing additional length to a conventional bed of the type having box springs and a mattress supported by a pair of opposed right angle shaped bed rails, comprising:

(a) a pair of opposed vertical leg members;

(b) a horizontal extender board providing a flat support surface extending between said leg members and suited to serve as a head rest, said extender board being mounted on, supported by and secured to said leg members; and (c) each of said leg members being formed with horizontal vertically spaced slots for receiving the horizontal portions of a pair of right angled bed rails enabling said leg members to engage and be supported by a pair of right angle shaped bed rails forming part of said type of conventional bed and said extender device to be vertically adjusted as an integral unit solely by selecting the slots in which the bed rails are positioned.

2. The bed extender device according to claim 1 wherein, said vertical leg members are formed from angle iron pieces.

3. The bed extender device according to claim 1 wherein said type of conventional bed includes a headboard and said bed extender device is adapted to be positioned and vertically adjusted adjacent said headboard such that an associated mattress and box springs may extend beyond the foot end of supporting bed rails associated therewith.

4. The bed extender device according to claim 1 wherein said type of conventional bed includes a headboard and a footboard and side rails of greater than normal 74 inch length to form an extended bed and said bed extender device is adapted to be positioned and vertically adjusted adjacent the headboard of said extender bed when an associated mattress and box springs are positioned adjacent said footboard.

5. The bed extender device according to claim 4 wherein, said extender device is adapted to be positioned and vertically adjusted adjacent the footboard of said extended bed when the mattress and box springs are positioned adjacent said headboard.

* * * * *